US005713484A

United States Patent [19]

Setty

[11] Patent Number: 5,713,484

[45] Date of Patent: Feb. 3, 1998

[54] TWO-PIECE PLASTIC CONTAINER AND REMOVABLE COVER

[75] Inventor: Thomas J. Setty, Florence, S.C.

[73] Assignee: Sonoco Products Company, Hartsville, S.C.

[21] Appl. No.: 625,402

[22] Filed: Mar. 26, 1996

[51] Int. Cl.[6] ..... B65D 35/00

[52] U.S. Cl. ..... 220/790; 220/789; 220/791; 220/793; 220/794; 220/787; 220/612; 220/613; 220/615; 220/618

[58] Field of Search ..... 220/783, 789, 220/790, 791, 793, 794, 319, 612, 613, 615, 618, 619, 620, 787, 792, 270

[56] References Cited

U.S. PATENT DOCUMENTS

| | | | |
|---|---|---|---|
| 3,117,691 | 1/1964 | Williams | 220/783 |
| 3,566,946 | 3/1971 | MacDonald . | |
| 4,030,630 | 6/1977 | Yealy | 215/256 X |
| 4,165,011 | 8/1979 | Holk, Jr. | 220/612 |
| 4,171,062 | 10/1979 | Allen et al. . | |
| 4,256,240 | 3/1981 | Woinarski . | |
| 4,296,871 | 10/1981 | Andersson | 220/792 X |
| 4,335,827 | 6/1982 | Knize et al. | 220/783 X |
| 4,401,225 | 8/1983 | Schwaikert | 220/787 X |
| 4,453,646 | 6/1984 | Harrild . | |
| 4,503,990 | 3/1985 | Roth et al. | 220/612 X |
| 4,520,943 | 6/1985 | Nielsen . | |
| 4,577,776 | 3/1986 | Rayner et al. . | |
| 4,711,364 | 12/1987 | Letica | 220/270 X |
| 4,878,595 | 11/1989 | Uhlig . | |
| 4,958,744 | 9/1990 | Bayly . | |
| 5,170,905 | 12/1992 | Luch . | |
| 5,249,701 | 10/1993 | Daehn | 220/612 |
| 5,328,047 | 7/1994 | Smith . | |
| 5,398,836 | 3/1995 | Luch et al. | 220/270 X |
| 5,460,287 | 10/1995 | Cargile et al. . | |
| 5,511,680 | 4/1996 | Kinne | 220/791 X |

FOREIGN PATENT DOCUMENTS

| | | | |
|---|---|---|---|
| 858334 | 12/1970 | Canada . | |
| 615885 | 1/1927 | France | 220/612 |
| 695497 | 9/1965 | Italy | 220/612 |

*Primary Examiner*—Allan N. Shoap
*Assistant Examiner*—Robin A. Hylton
*Attorney, Agent, or Firm*—Bell Seltzer Intellectual Property Law Group; Alston & Bird LLP

[57] ABSTRACT

A two-piece plastic container and removable cover is provided which is particularly adaptable for containing flowable products. The removable cover comprises a one-piece molded generally circular cover having an annular sealing projection extending generally downwardly in a perpendicular direction from an outer periphery of the cover and an annular locking projection extending generally upwardly in a perpendicular direction from the outer periphery of the cover. The container comprises a one-piece molded cylindrical body having a closed bottom and an open top. Two spaced concentric annular inside and outside projections extend longitudinally upwardly from the open top of the body of the container and define therebetween a cover sealing cavity for receiving the cover sealing projection and cooperating therewith to seal the cover on the container. The outside projection on the container is configured for extending partially around the locking projection on the cover and cooperating therewith to lock the cover on the container. Preferably, an opening device in the form of a finger tab or the like is provided for being gripped and pulled by a user for disengaging at least a portion of the outside projection on the container and the locking projection on the cover for removing the cover from the container.

12 Claims, 4 Drawing Sheets

TWO-PIECE PLASTIC CONTAINER AND REMOVABLE COVER

FIELD OF THE INVENTION

This invention relates to a two-piece plastic container and removable cover particularly adapted for containing flowable products.

BACKGROUND OF THE INVENTION

The flowable products industry, particularly those who package frozen and hard-to-hold juice concentrates, are always interested in improved packaging containers and have long been interested in plastic containers, particularly plastic containers having a closed plastic bottom and a removable plastic top cover. For varying reasons, commercially viable two-piece plastic containers and removable covers have not been commercially available for packaging of these products.

OBJECT AND SUMMARY OF THE INVENTION

Accordingly, it is the object of this invention to provide a commercially viable two-piece plastic container and removable cover which is particularly adapted for containing flowable products.

It has been found by this invention that this object may be accomplished wherein the removable cover comprises a one-piece molded generally circular cover having an annular sealing projection extending generally downwardly in a perpendicular direction from an outer periphery of the cover, and an annular locking projection extending upwardly in a perpendicular direction from the outer periphery of the cover. The container comprises a one-piece molded cylindrical body having a closed bottom and an open top and two spaced concentric annular inside and outside projections extending longitudinally upwardly from the open top of the body and defining therebetween a cover sealing cavity. This cover sealing cavity receives the cover sealing projection and cooperates therewith to seal the cover on the container. The outside projection of the container is configured for extending partly around the cover locking projection and cooperating therewith to lock the cover on the container.

Preferably, the removable cover includes opening means, which can be in the form of a finger tab integrally molded with and extending from the locking projection on the cover for being gripped and pulled by a user to disengage at least a portion of the outside projection on the container and the locking projection on the cover for removing the cover from the container.

The inside projection on the container is preferably of a generally upwardly tapered and flexible construction, the sealing projection on the cover is preferably of a generally downwardly tapered construction and the sealing cavity in the container is preferably smaller than the sealing projection the cover, so that the container inside projection will flex to receive the cover sealing projection in the container sealing cavity to establish sealing engagement. Optionally, a lining compound may be positioned in at least the bottom of the container sealing cavity to surround at least the bottom portion of the cover sealing projection when positioned therein to enhance the sealing between the cover and the container.

In one embodiment of the invention, the outside projection on the container is initially of length to extend above the cover locking projection when the cover is positioned on the container and is heat formed to extend over and around the upper end of the cover locking projection after the cover is positioned on the container. In another embodiment of the invention, the outside projection on the container is of a flexible construction and includes an inwardly-extending portion at the upper end thereof so that the container outside projection will flex outwardly when the cover is positioned on the container and the upper portion thereof will snap-lock over the upper end of the cover locking projection after the cover is positioned on the container. This inwardly-extending portion may optionally be heat formed to extend further around the upper end of the cover locking projection after snap-locking thereover. In either of these embodiments, the locking projection on the cover may be of a generally upwardly tapered construction.

BRIEF DESCRIPTION OF THE INVENTION

While some of the objects and advantages of this invention have been set forth above, other objects and advantages will become evident from the following more detailed description of preferred embodiments of the invention when taken in conjunction with accompanying drawings, in which.

DETAILED DESCRIPTION OF PREFERRED EMBODIMENTS OF THE INVENTION

Figure 1:
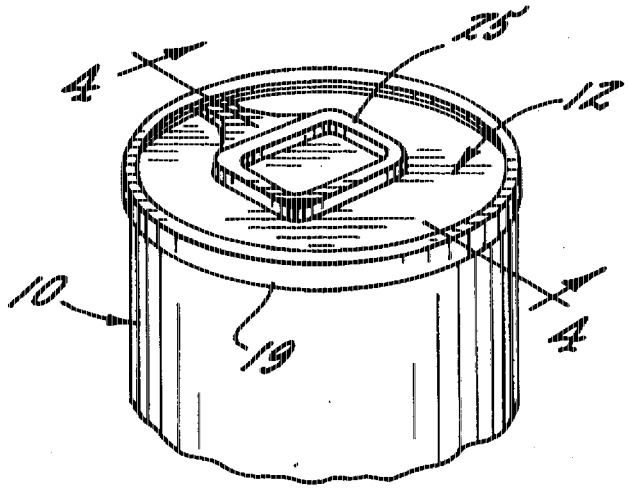
FIG. 1 is a partial perspective view of the upper portion of a two-piece plastic container and removable cover in accordance with this invention and having an opening tab thereon.

Referring now to the drawings, a two-piece plastic container 10 and removable cover 12 constructed in accordance with this invention are illustrated therein. This two-piece plastic container I 0 and removable cover 12 are particularly adapted for containing flowable products, such as frozen and hard-to-hold juice concentrates. This two-piece plastic container 10 and removable cover 12 could also be utilized for packaging a variety of other materials.

The removable cover 12 comprises a one-piece molded plastic generally circular configured cover having an annular sealing projection 13; extending generally downwardly in a perpendicular direction from an outer periphery of the cover 12 and an annular locking projection 14 extending generally upwardly in a perpendicular direction from the outer periphery of the cover 12. The removable cover 12 may be formed of polyethylene, polypropylene and other thermoplastic materials and is preferably injection molded in a one-piece construction in a manner well understood by those with ordinary skill in the art.

Figure 4:
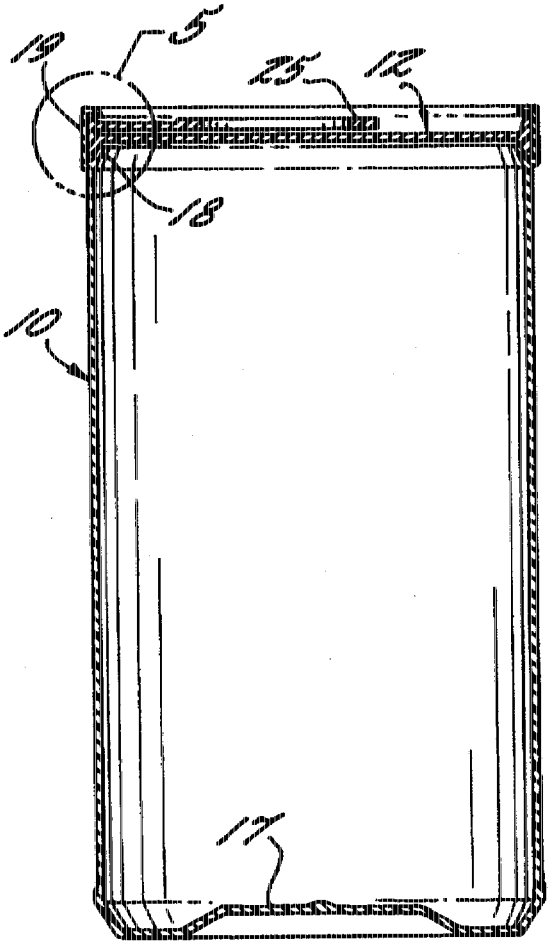
FIG. 4 is a slightly enlarged side sectional view of the entire two-piece plastic container and removable cover illustrated in FIG. 1.
Figure 5:
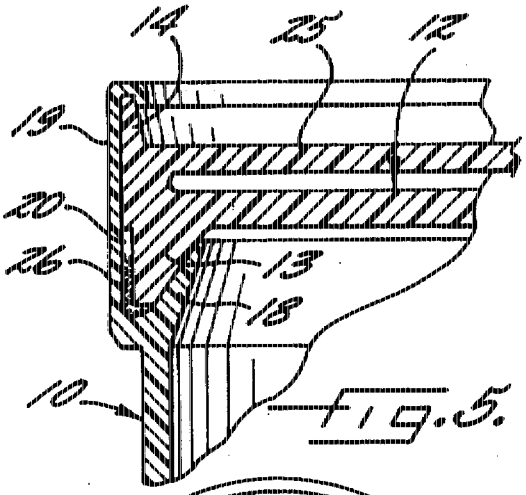
FIG. 5 is an enlarged, sectional detail of a portion of the two-piece plastic container and removable cover shown in FIG. 4 and taken within the circle 5 of FIG. 4.
Figure 7:
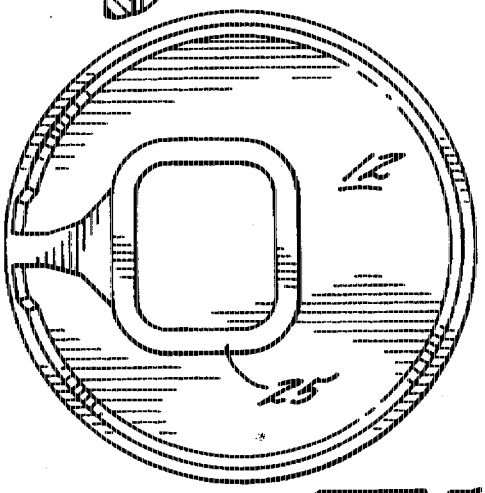
FIG. 7 is a top plan view, taken generally along the line 7—7 of FIG. 6.
Figure 6:
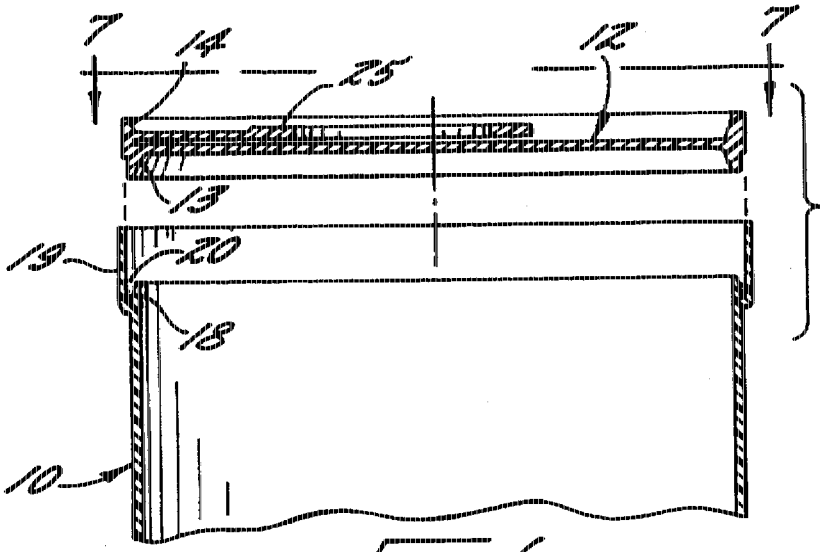
FIG. 6 is an enlarged, exploded view of the open upper end of the plastic container and removable cover of FIG. 4.

The container 10 is in the form of a one-piece molded cylindrical body having a closed bottom 17 and an open top. The container 10 further includes two spaced concentric annular inside and outside projections 18, 19 extending longitudinally upwardly from the open top of the cylindrical body of the container 10. These concentric annular inside and outside projections 18, 19 define therebetween a sealing cavity 20 for receiving the sealing projection 13; of the cover 12 and cooperating therewith to seal the cover 12 on the container 10 to contain the flowable materials within the container 10 when the cover 12 is positioned thereon. The outside projection 19 of the container 10 is suitably configured for extending partially around the locking projection 14 of the cover 12 and cooperating therewith to lock the cover 12 on the container 10, as shown particularly in FIGS. 4 and 5. The container 10 may be constructed of polyethylene, polypropylene and other thermoplastic materials and is preferably injection molded in a one-piece construction in a manner well understood by those with ordinary skill in the art.

Figure 2:
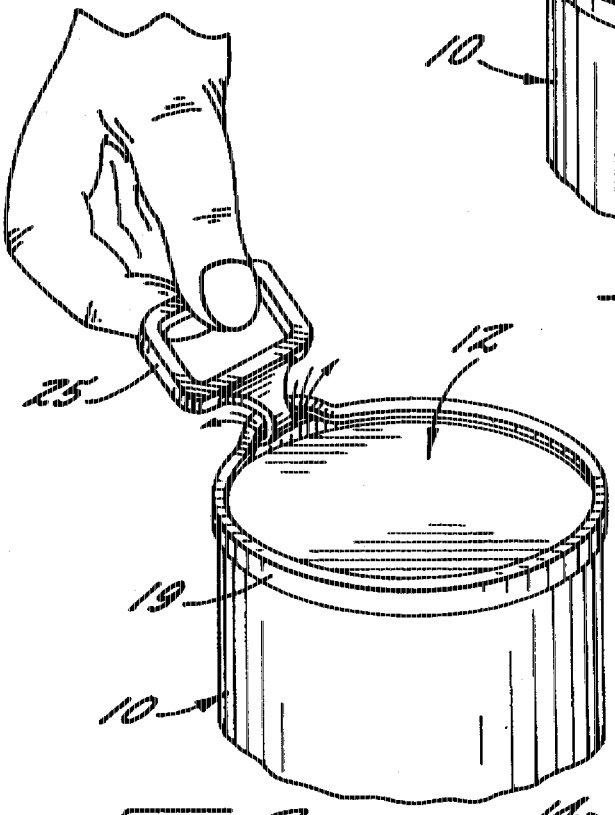
FIG. 2 is view, like FIG. 1, showing the opening tab disengaging the removable cover from the container.
Figure 3:
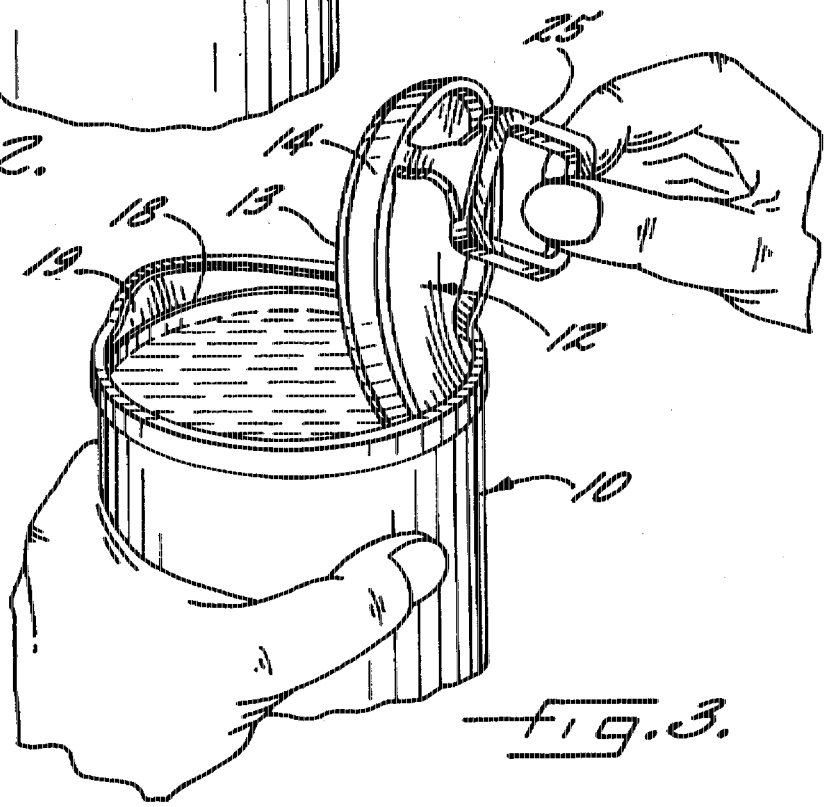
FIG. 3 is a view, like FIGS. 1 and 2, showing the removable cover partially removed form the container.

The removable cover 12 preferably includes an opening device for being gripped and pulled by a user for disengaging at least a portion of the outside projection 19 on the container 10 and the locking projection 14 on the cover 12 for removing the cover from the container, as shown in FIGS. 2 and 3. This opening device may be in the form of a finger tab integrally molded with and extending from the locking projection 14 on the cover 12 for pivotally moving the locking projection 14 when gripped and pulled upwardly by a user to disengage the locking projection 143 of the cover 12 from the outside projection 19 of the container 10, as shown in FIGS. 2 and 3, to remove the cover 12 from the container 10. This finger tab may be in the shape of a conventional circular, square or rectangular open ting attached by a leg to the cover 12 and is integrally molded with the cover 12.

For purposes of sealing the removable cover 12 on the container 10, the inside projection 18 on the container 10 is preferably of a generally upwardly tapered and flexible configuration and the sealing projection 13 on the cover 12 is preferably of a generally downwardly tapered construction. The container sealing cavity 20 between the projections 18 and 19 on the container 10 is preferably smaller than the cover sealing projection 13 so that the container inside projection 18 will flex to receive the cover sealing projection 13 in the container sealing cavity 20 to establish sealing engagement, as shown in FIGS. 8A–8C and 10A–10C. To enhance this sealing engagement, a suitable lining compound 26 is positioned in at least the bottom of the container sealing cavity 20 to surround at least the bottom portion of the cover sealing projection 13 when positioned therein to enhance the sealing between the container 10 and the cover 12. Suitable lining compounds include compatible thermoplastic resins, waxes and synthetic rubbers, possibly with plasticizers, filler and other additives to adapt performance for a specific application.

Figure 8A:
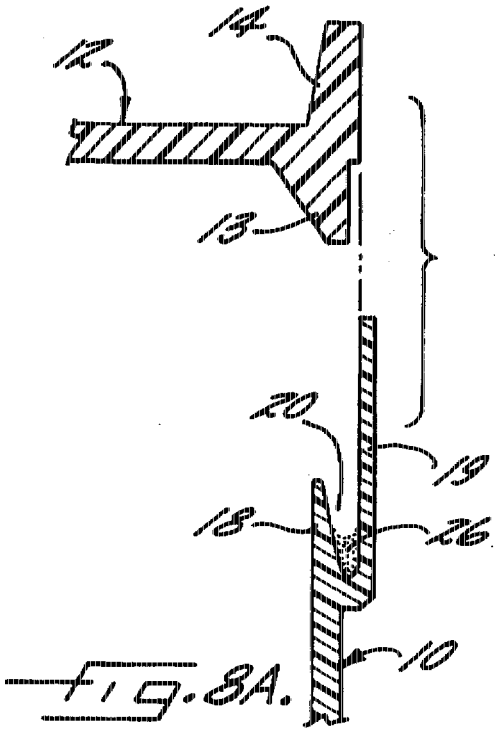
FIGS. 8A–8C are sequential views of a first embodiment of the two-piece plastic container and removable cover showing the removable cover being positioned on the container.
Figure 8B:
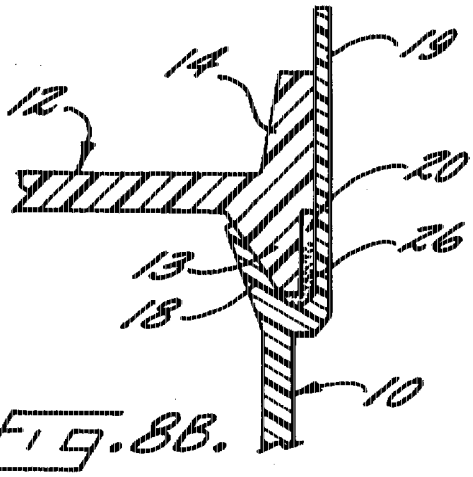
Figure 8C:
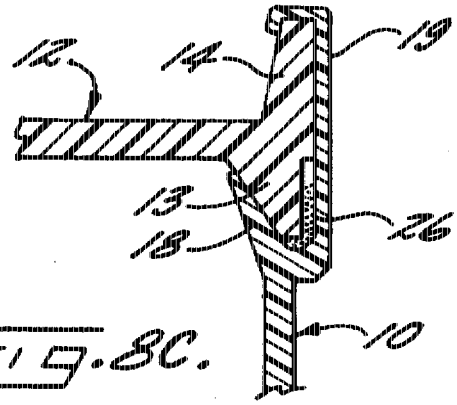
Figure 9:
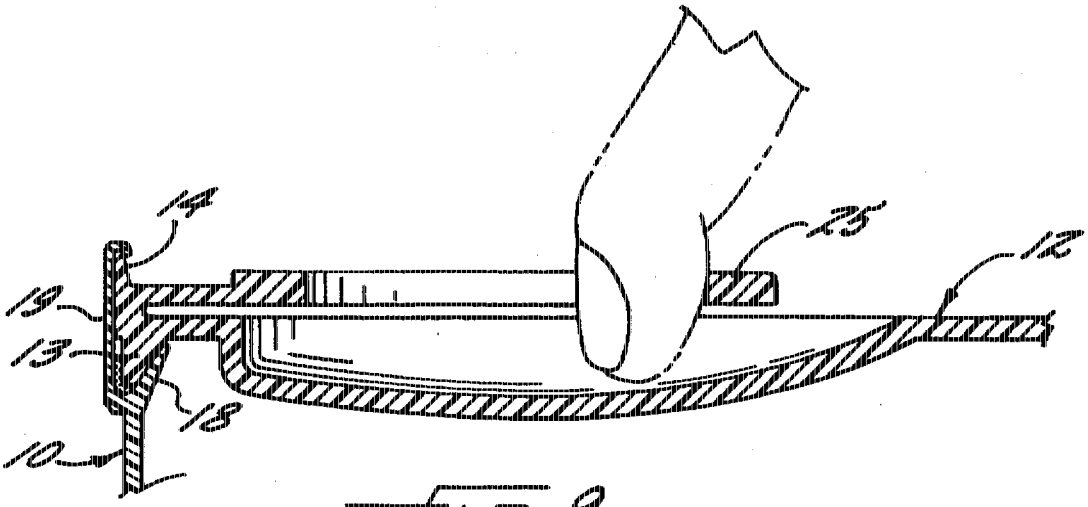
FIG. 9 is an enlarged, partial, sectional view of the upper end of the two-piece plastic container and removable cover as shown in FIG. 4, and illustrating the finger of a user positioned in the finger tab opening means.

In a first embodiment of the two-piece plastic container 10 and removable cover 12 in accordance with this invention, as illustrated in FIGS. 1–9, the outside projection 19 of the container 10 is initially of a length to extend above the locking projection 14 on the cover 12 when the cover 12 is positioned on the container 10, as shown in FIG. 8B. The outer end of this cover locking projection 19 is heat formed using heat, pressure or a combination thereof, in a manner well understood by those with ordinary skill in the art, to extend over and around the upper end of the cover locking projection 14 after the cover 12 is positioned on the container 10, as shown in FIG. 8C. The cover locking projection 14 is preferably of a generally upwardly tapered construction.

Figure 10A:
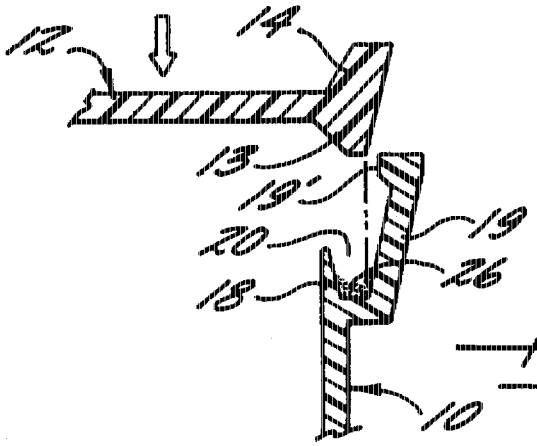
FIGS. 10A–10C are sequential views of a second embodiment of the two-piece plastic container and a removable cover showing the removable cover being positioned on the plastic container.
Figure 10B:
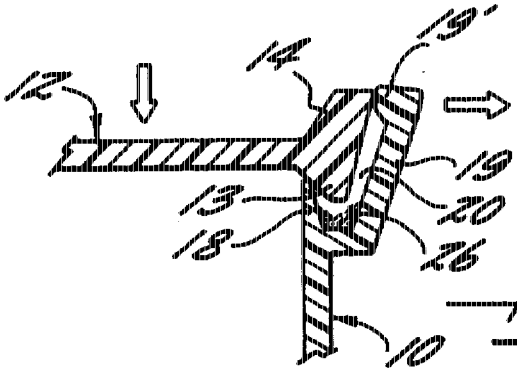
Figure 10C:
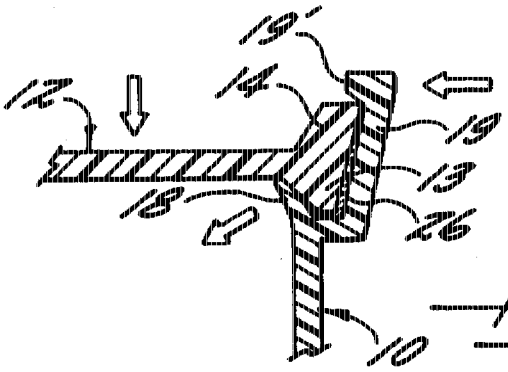
Figure 11:
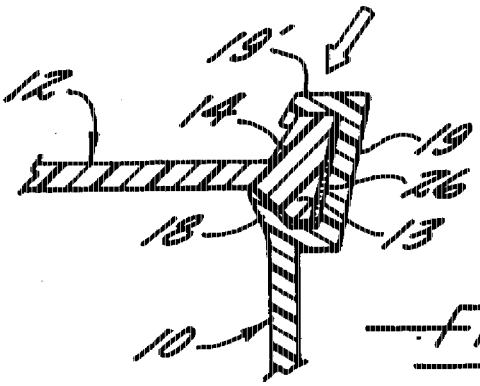
FIG. 11 illustrates an optional additional step in positioning and closing the upper end.

In a second embodiment of a two-piece plastic container 10 and removable cover 12, as illustrated in FIGS. 10A–10C and 11, the container outside projection 19 is of a flexible construction and includes an inwardly-projecting portion 19' at the upper end thereof so that the container outside projection 19 will flex outwardly when the cover 12 is being positioned on the container 10 as shown in FIG. 10B, and will then snap-lock over the upper end of the cover locking projection 14 after the cover 12 is positioned on the container 10, as shown in FIG. 10C. Optionally, the inwardly-extending portion 19' of the outside projection 19 of the container 10 may be further formed using heat, pressure or a combination thereof to extend further around the upper end of the locking projection 14 on the cover 12, as indicated in FIG. 1, to enhance locking engagement.

Thus, embodiments of a two-piece plastic container 10 and removable cover 12 have been provided which are adapted to container flowable products and which can be made of the same or similar plastic materials and which are preferably injection molded and which provides a viable all plastic container for the flowable products industry.

In the drawings and the specification, there has been set forth preferred embodiments of the invention and, although specific terms are employed, the terms are used in a genetic and descriptive sense only and not for purpose of limitation, the scope of the invention being set forth in the following claims.

What is claimed is:

1. A two-piece plastic container and removable cover for containing flowable products, wherein;

said removable cover comprising a one-piece molded circular cover having an annular sealing projection extending downwardly in a perpendicular direction from adjacent the outer periphery of said cover and an annular locking projection extending upwardly in perpendicular direction from the outer periphery of said cover; and said container comprising a one-piece molded cylindrical body having a closed bottom and an open top and two spaced concentric annular inside and outside projections extending longitudinally upwardly from said open top of said body and defining therebetween a cover sealing cavity for receiving said cover sealing projection and cooperating therewith to seal said cover on said container, said outside projection being configured and being initially of a length to extend above said cover locking projection when said cover is positioned on said container and is formed to extend over and around the upper end of said cover locking projection after said cover is positioned on said container to lock said cover on said container.

2. A two-piece plastic container and removable cover, as set forth in claim 1, in which cover locking projection is of an upwardly tapered construction.

3. A two-piece plastic container and removable cover for containing flowable products, wherein;

said removable cover comprising a one-piece molded circular cover having an annular sealing projection extending downwardly in a perpendicular direction from adjacent outer periphery of said cover and an annular locking projection extending upwardly in a perpendicular direction from the outer periphery of said cover; and said container comprising a one-piece molded cylindrical body having a closed bottom and an open top and two spaced concentric annular inside and outside projections extending longitudinally upwardly from said open top of said body and defining therebetween a cover sealing cavity for receiving said cover sealing projection and cooperating therewith to seal said cover on said container, said outside projection being configured for extending partially around said cover locking projection and cooperating therewith to lock said cover on said container and being of a flexible construction and including an inwardly-extending portion at the upper end thereof so that said container outside projection will flex outwardly when said cover is positioned on said container and the upper portion thereof will snap-lock over the upper end of said cover locking projection after said cover is positioned on said container.

4. A two-piece plastic container and removable cover, as set forth in claim 3, in which said cover locking projection is of an upwardly tapered construction.

5. A two-piece plastic container and removable cover for containing flowable products, wherein;

said removable cover comprising a one-piece molded circular cover having an annular sealing projection extending downwardly in a perpendicular direction from adjacent the outer periphery of said cover and an annular locking projection extending upwardly in a perpendicular direction from the outer periphery of said cover;

said container comprising a one-piece molded cylindrical body having a closed bottom and an open top and two spaced concentric annular inside and outside projections extending longitudinally upwardly from said open top of said body and defining therebetween a cover sealing cavity for receiving said cover sealing projection and cooperating therewith to seal said cover on said container, said outside projection being configured for extending partially around said cover locking projection and cooperating therewith to lock said cover on said container; and opening means forming a part of said removable cover for being gripped and pulled by a user for disengaging at least a portion of said outside projection on said container and said locking projection on said cover for removing said cover from said container.

6. A two-piece plastic container and removable cover, as set forth in claim 1, in which said opening means comprises a finger tab integrally molded with and extending from said locking projection on said cover for pivotally moving said locking projection when gripped and pulled upwardly by the user.

7. A two-piece plastic container and removable cover, as set forth in claim 5, in which said container inside projection is of an upwardly tapered and flexible construction, said cover sealing projection is of a downwardly tapered construction, and said container sealing cavity is smaller than said cover sealing projection so that said container inside projection will flex to receive said cover sealing projection in said container sealing cavity to establish sealing engagement.

8. A two-piece plastic container and removable cover, as set forth in claim 5 or 7, further including lining compound positioned in at least the bottom of said container sealing cavity to surround at least the bottom portion of said cover sealing projection when positioned therein to enhance the sealing between said container and said cover.

9. A two-piece plastic container and removable cover for containing flowable products, wherein;

said removable cover comprising a one-piece molded circular cover having an annular sealing projection extending downwardly in a perpendicular direction from adjacent the outer periphery of said cover and being of a downwardly tapered construction and an annular locking projection extending upwardly in a perpendicular direction from the outer periphery of said cover;

said container comprising a one-piece molded cylindrical body having a closed bottom and an open top and two spaced concentric annular inside and outside projections extending longitudinally upwardly from said open top of said body and defining therebetween a cover sealing cavity for receiving said cover sealing projection and cooperating therewith to seal said cover on said container, said container inside projection being of a an upwardly tapered and flexible construction and said container sealing cavity being smaller than said cover sealing projection so that said container inside projection will flex to receive said cover sealing projection in said container sealing cavity to establish sealing engagement, said container outside projection being initially of a length to extend above said cover locking projection when said cover is positioned on said container and being formed to extend over and around the upper end of said cover locking projection after said cover is positioned on said container for cooperating with said cover locking projection to lock said cover on said container; and said removable cover further including opening means for being gripped and pulled by a user for disengaging at least a portion of said outside projection on said container and said locking projection on said cover for removing said cover from said container.

10. A two-piece plastic container and removable cover for containing flowable products, wherein;

said removable cover comprising a one-piece molded circular cover having an annular sealing projection extending downwardly in a perpendicular direction from adjacent the outer periphery of said cover and being of a downwardly tapered construction and an annular locking projection extending upwardly in a perpendicular direction from the outer periphery of said cover;

said container comprising a one-piece molded cylindrical body having a closed bottom and an open top and two spaced concentric annular inside and outside projections extending longitudinally upwardly from said open top of said body and defining therebetween a cover sealing cavity for receiving said cover sealing projection and cooperating therewith to seal said cover on said container, said container inside projection being of an upwardly tapered and flexible construction and said container sealing cavity being smaller than said cover sealing projection so that said container inside projection will flex to receive said cover sealing projection in said container sealing cavity to establish sealing engagement, said container outside projection being of a flexible construction and of a length to extend above said cover locking projection when said cover is positioned on said container and having an inwardly-extending portion at the upper end thereof so that said container outside projection will flex outwardly when said cover is positioned on said container and the upper portion thereof will snap-lock over the upper end of said cover locking projection after said cover is positioned on said container to lock said cover on said container; and said removable cover further including opening means for being gripped and pulled by a user for disengaging at least a portion of said outside projection on said container and said locking projection on said cover for removing said cover from said container.

11. A two-piece plastic container and removable cover, as set forth in claim 9 or 10, in which said opening means comprises a finger tab integrally molded with and extending from said locking projection on said cover for pivotally moving said locking projection when gripped and pulled upwardly by the user.

12. A two-piece plastic container and removable cover, as set forth in claim 9 or 10, further including a lining compound positioned in at least the bottom of said container sealing cavity to surround at least the bottom portion of said cover sealing projection when positioned therein to enhance the sealing between said container and said cover.

* * * * *

UNITED STATES PATENT AND TRADEMARK OFFICE

CERTIFICATE OF CORRECTION

PATENT NO. : 5,713,484

DATED : February 3, 1998

INVENTOR(S) : Thomas J. Setty

It is certified that error appears in the above-identified patent and that said Letters Patent is hereby corrected as shown below:

Column 2, line 64, "I0" should be -- 10 --.

Column 3, line 41, "143" should be -- 14 --.

Column 5, line 5, after "adjacent" insert -- the --.

Column 6, line 40, after "and" begin a new paragraph with "said".

Signed and Sealed this

Second Day of June, 1998

*Attest:*

*Attesting Officer*

Bruce Lehman

BRUCE LEHMAN

*Commissioner of Patents and Trademarks*